United States Patent [19]

Moriarty et al.

[11] 4,102,770

[45] Jul. 25, 1978

[54] ELECTROPLATING TEST CELL

[75] Inventors: William L. Moriarty, South Meriden; Robert G. Zobbi, Southbury, both of Conn.

[73] Assignee: American Chemical and Refining Company Incorporated, Waterbury, Conn.

[21] Appl. No.: 816,285

[22] Filed: Jul. 18, 1977

[51] Int. Cl.[2] ..... G01N 27/26; C25D 17/00

[52] U.S. Cl. ..... 204/195 R; 204/212; 204/260; 204/261; 204/263; 204/272; 204/273; 204/274

[58] Field of Search ..... 204/272, 273, 274, 275, 204/260, 261, 262, 263, 264, 195 R, 212, 215, 216, 217, 218; 324/29

[56] References Cited

U.S. PATENT DOCUMENTS

| | | | |
|---|---|---|---|
| 2,585,059 | 2/1952 | Wallace | 204/195 |
| 2,606,148 | 8/1952 | Portanova et al. | 204/263 X |
| 2,760,928 | 8/1956 | Ceresa | 204/195 R |
| 2,801,963 | 8/1957 | Hull et al. | 204/195 R |
| 3,215,609 | 11/1965 | Chapdelaine | 204/1 T |
| 3,345,281 | 10/1967 | Falls | 204/212 |
| 3,580,833 | 5/1971 | Cooper | 204/212 |
| 3,853,734 | 12/1974 | Ellis et al. | 204/212 |
| 3,915,832 | 10/1975 | Rackus et al. | 204/212 |
| 3,985,634 | 10/1976 | Larson et al. | 204/212 |

*Primary Examiner*—G. L. Kaplan

[57] ABSTRACT

An electroplating test cell comprises a tank having a housing supported within it, the housing being divided into an annular anode compartment and an inner cathode compartment. A cylindrical cathode support is mounted for rotation within the cathode compartment and is vertically adjustable therein to vary its position relative to electrolyte flowed within the compartment. The housing is supported near the bottom of the tank so that different levels of electrolyte may be maintained above the housing to provide varying liquid conditions ranging from a static pressure head to spray chamber plating. Rotation speed of the cathode support is variable to simulate different speeds of material movement through a plating bath.

26 Claims, 2 Drawing Figures

ELECTROPLATING TEST CELL

BACKGROUND OF THE INVENTION

The present invention relates to electroplating test cells and more particularly to electroplating cells particularly adapted to test on a small or laboratory scale different plating materials and conditions. Test cells are, of course, known to the prior art, for example, one well-known type is the Hull cell. Electroplating test cells usually comprise a beaker or small tank arranged to plate a small test piece of material.

Generally, it is desired to simulate as closely as possible the plating conditions and materials encountered in commercial equipment, existing or planned. Generally, the prior art devices are arranged to simulate different relative speeds of electrolyte solution relative to the material to be plated by rotating the test piece within the solution. Pumps may also be employed to flow the electrolyte at a selected rate. One test cell is described in U.S. Letters Patent No. 3,215,609 and shows an anode chamber separated from a cathode chamber by a perforated wall. U.S. Letters Pat. No. 3,915,832 shows an electroplating cell employing cylindrical anodes and illustrating an electrode support of cylindrical configuration driven by a drive shaft connected to a motor means which is mounted above the tank. There are numerous other prior patents illustrating various cell embodiments.

Generally however, prior art devices are deficient in one or more aspects of their ability to provide simulation of liquid distribution patterns and flow rates, spacing between electrodes, temperature control of electrolyte and other plating variables.

It is accordingly an object of the present invention to provide a novel electroplating test cell structure which provides the ability to simulate a wide range of plating conditions in a simple and economical structure.

It is another object of the present invention to provide an electroplating test cell structure in which cathode speed relative to electrolyte solution may be varied over a wide range, in which the pattern of electrolyte distribution may be similarly varied and in which electrode spacing and the liquid pressure of the electrolyte may be varied while maintaining close control of electrolyte temperature.

It is another object of the present invention to provide a simple, efficient and novel electroplating test cell structure suitable to simulate a wide variety of commercial plating conditions in a laboratory or pilot plant sized apparatus.

SUMMARY OF THE INVENTION

In accordance with the present invention, there is provided an electroplating test cell comprising a tank having a bottom wall and a side wall defining a main chamber, and a housing within the main chamber. The housing has an outer peripheral wall, a top and a bottom defining a housing chamber. Means for supporting the housing within the main chamber are provided as is a cathode support means which carries cathode connector means thereon and is disposed within the housing chamber and adapted to support a generally annular cathode thereon in electrical contact with the cathode connector means. An anode support means is disposed within the housing chamber and an annular anode means is carried by the anode support means outwardly of the cathode support means to define an annular space therewith. Rotation/support means for rotatably mounting and effecting rotation of the cathode support means, and thereby a cathode supported thereon, within the housing chamber are provided. The rotation/support means includes adjustable mounting means supported within the tank and being adjustable for movement within the cathode compartment for supporting and positioning the cathode support means at a selected one of different positions within the housing chamber. An inlet conduit is disposed in liquid flow communication with the housing chamber to introduce a liquid electrolyte therein, and an outlet conduit is disposed in liquid flow communication with the housing chamber to withdraw liquid electrolyte therefrom. An electrical connector means adapted to connect the anode and the cathode connector means to respective terminals of an electrical source is also provided.

Certain objects of the invention are attained when the rotation/support means comprises adjustable mounting means having one end supporting the cathode support means at a selected one of the different positions, and drive means connected to the cathode support means for effecting the rotation thereof. The adjustable mounting means may comprise a support stud adjustably fastened to the bottom of the housing, said stud projecting upwardly into the cathode compartment and terminating therein in a bearing end comprising the one end, and the cathode block has a bearing seat thereon which is seated upon the bearing end. The drive means may comprise a drive shaft having one end thereof connected to the cathode support means, and the support stud and cathode support means are movable relative to the bottom of the housing in a direction parallel to the longitudinal axis of the shaft.

Certain objects of the invention are attained when the cathode connector and the shaft are made at least in part of metal and the cathode connector is disposed in electrical conducting contact with the shaft whereby the shaft and the cathode connector cooperate to provide a portion of the electrical connector means.

Other objects of the invention are attained when the housing further includes a compartmental wall disposed therein and defining an inner cathode compartment and an annular anode compartment disposed outwardly about the cathode compartment, and the top of the housing has a central aperture formed in the cathode compartment portion thereof, at least a component of the rotation means extending through the central aperture, and the bottom of the housing has at least one aperture formed in the cathode compartment portion thereof.

Advantageously, in accordance with the invention, the annular anode means comprises an outer annular anode and an inner annular anode disposed inwardly of the outer annular anode, and the anode support means comprises first anode support means supporting the outer annular anode and second anode support means supporting the inner annular anode. The outer annular anode is preferably disposed within the anode compartment and the inner annular anode is disposed within the cathode compartment, and the annular anode means are of perforate construction whereby to admit the passage of a liquid therethrough. Heat exhange means may be disposed within the tank for heat exhange with liquid contained therein.

DETAILED DESCRIPTION OF THE ILLUSTRATED EMBODIMENTS

Figure 1:
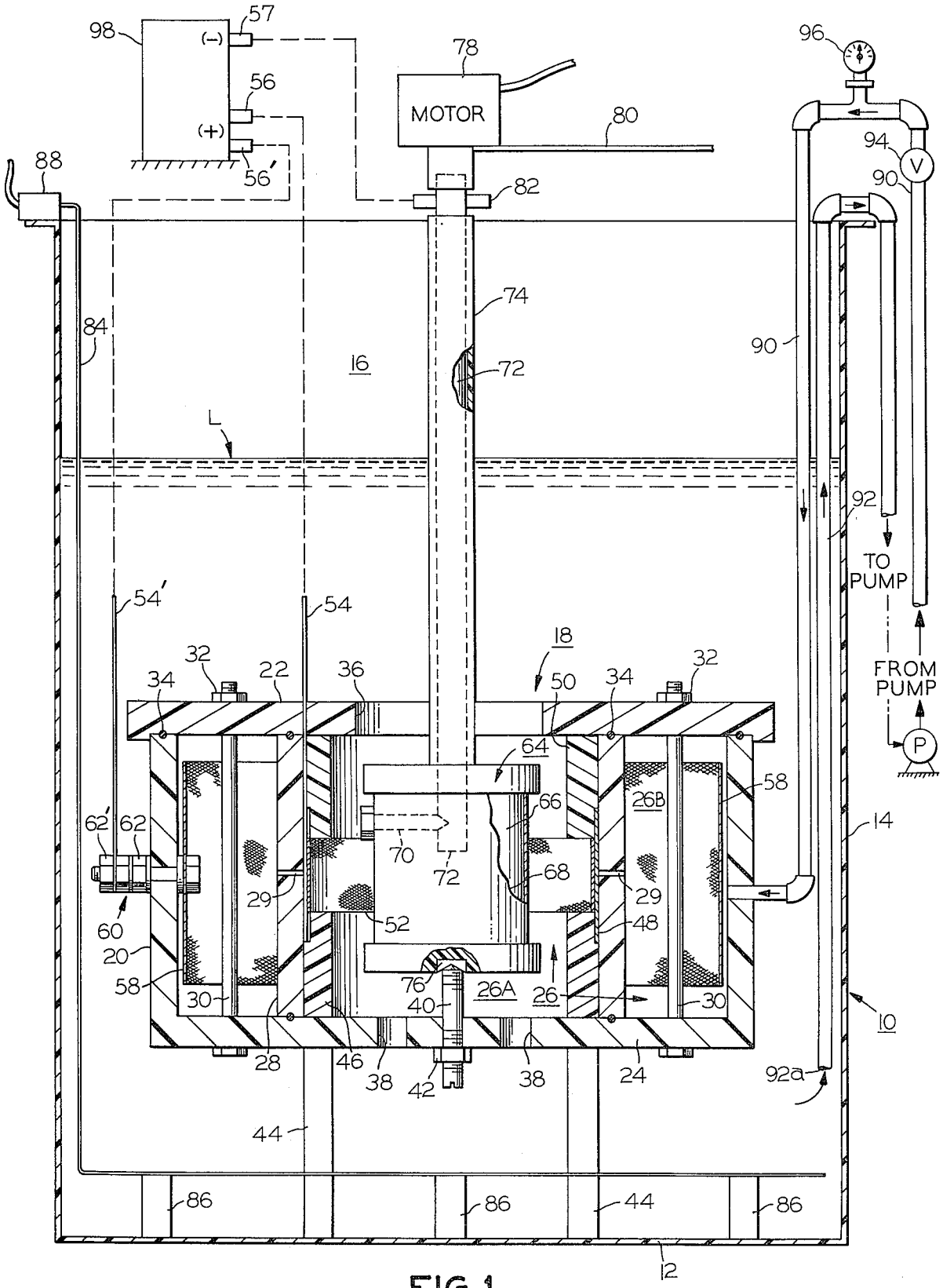
FIG. 1 is a section view in elevation of one embodiment of the present invention.
Figure 2:
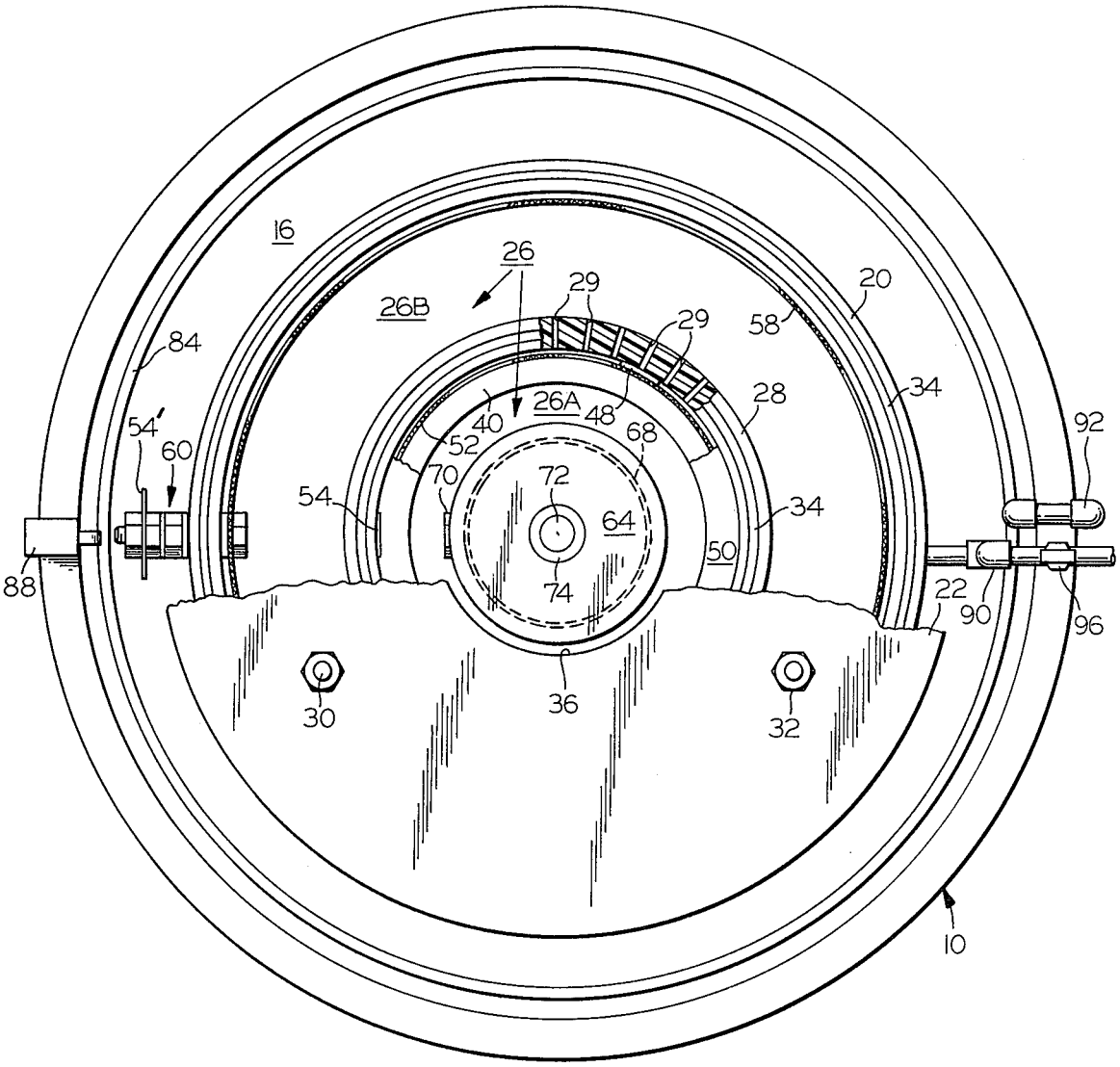
FIG. 2 is a plan view of the embodiment of FIG. 1 with parts broken away for clarity of illustration.

Referring to FIGS. 1 and 2, a tank 10 has a bottom wall 12 and a side wall 14 defining a main chamber 16. A housing generally indicated at 18 has an outer peripheral wall 20, a top provided by a top wall 22 and a bottom 24 defining a housing chamber generally indicated at 26. A compartmental wall 28 is disposed within housing chamber 26. As best seen in FIG. 2, compartmental wall 28 is cylindrical in shape and divides housing chamber 26 into an inner cathode compartment 26A and an annular anode compartment 26B. A plurality of apertures 29 are disposed about the periphery of compartmental wall 28. As seen in both FIGS. 1 and 2, apertures 29 extend radially through compartmental wall 28 and provide passageways connecting anode compartment 26B in liquid flow communication with cathode compartment 26A. Top 22 is secured to housing 18 by tie rods 30, preferably made of titanium, which by means of nuts 32 tightly seat top wall 22 to the upper edges of outer peripheral wall 20. Ring gaskets 34 are employed to provide liquid tight sealing between compartmental wall 28 and top wall 22 and peripheral wall 20 of housing 18.

Top wall 22 has a central aperture 36 formed therein in the cathode compartment portion thereof, and bottom wall 24 of housing 18 has a pair of apertures 38 formed therein also in the cathode compartment portion thereof.

A small central aperture (unnumbered) is also formed in bottom 24 of housing 18 and adjustable mounting means comprising a support stud 40 is threadably fastened therein and secured in place by a retaining nut 42. As described more fully hereinbelow, support stud 40 is selectively movable in bottom 24 so that the upper bearing end of stud 40 may be positioned a selected elevation above the inside surface of bottom 24. As is shown by the drawings, support stud 40 thus provides adjustable mounting means to support the cathode support means for positioning thereof.

Housing 18 is seated upon housing supports 44 which support housing 18 above bottom wall 12 of tank 10.

A first anode retaining collar 46 of cylindrical configuration is disposed within cathode compartment 26A at the bottom thereof and has recesses (unnumbered) formed at spaced intervals about the circumference of its outer wall within which are disposed flat bar supports 48 (FIG. 2) which extend upwardly and receive at their upper ends (as best seen in FIG. 1) a second anode retaining collar 50. Second anode retaining collar 50 has similar recesses spaced about its outer periphery to receive the upper ends of bar supports 48. An inner anode 52 is of cylindrical shape and perforate construction and is seated between anode retaining collars 46 and 50. Inner anode 52 may be made of any suitable material, but is preferably made of a titanium screen. An insulated anode electrical connector 54 which is preferably made of titanium coated with a suitable insulator such as polyvinyl chloride connects inner anode 52 to the positive terminal 58 of a suitable source 98 of electrical energy.

An outer anode 58 is of similar construction to inner anode 52, but of larger diameter and height and cylindrical outer anode 58 is disposed within anode compartment 26B and supported therein by outer anode retainers 60, only one of which is shown in the drawings, and which comprise a plurality of titanium bolts retained by titanium nuts 62 at spaced apart locations about the periphery of outer anode 58. Titanium nuts 62' secure a second insulated anoe electrical connector 54' to the positive terminal 56' of a source of electrical energy. In this manner, the bolts (unnumbered) serve both as outer anode retainers 60 as well as a portion of the electrical connector means connecting the anodes 52 and 54 in electrical circuit relationship with a cathode as described hereinbelow. Obviously, leads 54, 54' may be connected to different or the same sources and suitable switches, electrical controls, etc., are provided.

Disposed within cathode compartment 26A is a generally cylindrical cathode support means 64 which has a recessed cylindrical support surface 66. Support surface 66 is adapted to have placed thereon a rectangular strip of cathode material 68 comprising a metal strip to be test plated. Strip 68 is held in place upon cylindrical support surface 66 by a cathode connector 70 preferably comprising a stainless steel bolt seated in a radially extending passageway (unnumbered) extending through cathode support means 64. Cathode connector 70, by virtue of its enlarged head portion, is firmly seated in electrical conducting contact with cathode material 68. The opposite pointed end of cathode connector 70 is seen to be seated in electrical conducting contact with a drive shaft 72 which is made of an electrical conducting metal, preferably stainless steel, and has a recess formed in the lower end thereof to receive the pointed end of cathode connector 70. Drive shaft 72 is coated with a sheath 74 of electrical insulating material such as polyvinyl chloride. The lower end of drive shaft 72 is nonrotatably affixed to cathode support means 64 by virtue of the engagement of cathode connector 70 with shaft 72. Obviously, suitable key or other means may be employed to supplement the locking of shaft 72 to cathode support means 64 whereby shaft 72 will rotate cathode support means 64 and thereby cathode material 68. The lowermost surface of cathode support means 64 contains a recessed bearing seat 76 formed therein which is rotatably seated upon the upper bearing end of support stud 40.

The upper end of shaft 72 is drivingly engaged with motor means 78 to provide the motive power for rotating shaft 72. Motor means 78 is supported by a motor mount 80 in any convenient manner. Motor mount 80 is broken away for clarity of illustration, but obviously it may be supported by an overhead support means or by the upper lip of tank 10, etc.

Adjacent the upper end of shaft 72 just below its connection to motor means 78 a portion of the surface of shaft 72 is exposed by termination of sheath 74 short of motor means 78. To this exposed portion of shaft 72 an electrical bushing 82 is connected in electrical conducting relation to shaft 72 and by means of a suitable lead connects shaft 72 electrically to the negative terminal 57 of an electrical source whose positive terminals are 56 and 56'.

Cathode support means 64 is made of a dielectric, i.e., electrical insulating material such as, for example, polyvinyl chloride, polyethylene, polypropylene, a polytetrafluoroethylene such as that sold under the trademark TEFLON, polyvinylidene chloride, etc.

It will be observed that drive shaft 72 and supporting stud 40 cooperate to provide rotation/support means for rotatably mounting and effecting rotation of cathode support means 64, and thereby of cathode material 68 supported thereon, within cathode compartment 26A. Cathode support means 64 is supported centrally of cathode compartment 26A, that is, the longitudinal central axis of the cylindrical cathode support means 64 is aligned with the longitudinal center axis of the cylinder provided by compartmental wall 28. It will be noted that the diameter of central aperture 38 is larger than the outside diameter of cathode support means 64 so as to permit insertion and withdrawal of cathode support means 64 into and out of anode compartment 26A without need to disassemble housing 18. Central aperture 38 is large enough to also admit the head portion of cathode connector 70 which may or may not extend beyond the end shoulder portions of cathode support means 64.

Heat exchange means, comprising in the embodiment shown a titanium coil 84, extends downwardly into tank 10 and is coiled beneath housing 18 and supported slightly above bottom wall 12 of tank 10 on coil support means 86. In the embodiment shown, titanium coil 84 contains within it electrical resistance heating elements and is connected to a heater junction box 88. Obviously, a second coil may be provided for cooling in addition to coil 84. In an alternate construction, coil 84 may be adapted to receive either a heating or cooling fluid for passage in indirect heat exchange through the walls of coil 84 with liquid electrolyte contained within tank 10.

An inlet conduit 90 receives liquid electrolyte from a pump P. Inlet conduit 90 is connected in fluid flow communication with housing 18, in the embodiment shown, by being connected to a radial passageway (unnumbered) formed in outer peripheral wall 20 whereby inlet conduit 90 may introduce liquid electrolyte directly into anode compartment 26B. A liquid outlet conduit 92 is positioned within tank 10 with its inlet opening end 92A positioned below bottom 24 of housing 18 and extends upwardly out of tank 10 and connects to the inlet of pump P. Inlet conduit 90 may be provided with a control valve 94 and a pressure gage 96.

In operation, a suitable liquid electrolyte is introduced by means of pump P into housing 18, more specifically into anode compartment 26B thereof, and passes through apertures 29 into cathode compartment 26A. The screen or apertured construction of outer anode 58 permits the liquid electrolyte to flow therethrough. Obviously, if outer anode 58 were of imperforate construction, the liquid electrolyte would simply flow around it to fill anode compartment 26B. The electrolyte enters cathode compartment 26A through apertures 29 and flows across cathode material 68, passing through the screen construction of inner anode 52. Inner anode 52 could alternatively be of solid construction, and the electrolyte would flow around it into cathode compartment 26A. However, in the embodiment illustrated, the resulting passageway for liquid flow would be quite small if solid, i.e., imperforate, anodes were employed. In such case, a plurality of apertures similar to apertures 29 could be formed in compartmental wall 28 above and/or below inner anode 52. Even with the use of a perforated inner anode 52, additional courses of apertures 29 might be employed to provide different liquid distribution patterns within anode compartment 26A. These options can be readily availed of by disassembling housing 18 and replacing compartmental wall 28 with another compartmental wall having a different pattern of apertures 29 therein. As will be clear from the drawings, disassembly of housing 18 is relatively simple, requiring only a loosening of nuts 32 and removal of top 22 after withdrawal of cathode support means 64 and shaft 72.

With a selected compartmental wall 28 in place and the desired velocity and distribution pattern of electrolyte obtained by a proper setting of control valve 94 as indicated by gage 96, the relative speed of cathode material 68 to electrolyte liquid may be maintained and adjusted as desired by the revolution speed of shaft 72. It will be noted that two variables are provided, the RPMs of shaft 72 as controlled by suitable controls on motor means 78 and the velocity of liquid electrolyte flow as controlled by pump P and valve 94. Liquid distribution may be further controlled and/or varied by adjusting the height of cathode support means 64 within anode compartment 26A thereby changing the distribution pattern, for any given compartmental wall 28, of liquid relative to the test cathode material 68.

The source of DC electrical energy, schematically indicated at 98, is appropriately connected to drive shaft 72 and to one or both of inner anode 52 and outer anode 58. Electrical current densities of selected value are thereby maintained across the annular space defined by the cathode material 68 and one or both of anodes 52 and 58.

The height of liquid electrolyte within tank 10 may be maintained at any desired level. For example, at the liquid level L illustrated in FIG. 1, a static pressure head of liquid within cathode compartment 26A is maintained. This static pressure head may be increased or decreased by suitably raising or lowering the level of liquid within tank 10. When liquid level L is above housing 18, the liquid electrolyte flows from cathode compartment 26A outwardly through central aperture 36 and apertures 38. If the liqud level L is maintained at or below top 22 of housing 18, liquid flows outwardly of cathode compartment 26A through apertures 38. If the liquid level L is maintained below bottom 24 of housing 18, cathode compartment 26A may be operated as a spray-type plating chamber. In such case, the liquid level within tank 10 is normally maintained above the lower portion of coil 84 to provide heat exchange for controlling the temperature of the liquid electrolyte.

As will be apparent from FIG. 1, the electrical connector means connecting cathode connector 70 (and thereby a test cathode strip 68) and anodes 52 and/or 58 to, respectively, negative and positive terminals of electrical source 98 is provided by the electrical connection between strip 68, cathode connector 70 and shaft 72 via bushing 82 and its associated lead on the one hand, and on the other hand, by anode electrical connectors 54 and 54'.

Tank 10 should be constructed of material inert to plating by the electrolyte and may suitably be made of polyvinyl chloride plastic or other suitable material. Conduits 90 and 92 are preferably made of a suitable plastic, i.e., synthetic, organic polymeric material such as polyvinyl chloride.

Motor mount 80 is made adjustable so that when it is desired to raise or lower cathode support means 64, motor means 78 and shaft 72 may be raised or lowered in cooperation with corresponding raising or lowering of support stud 40 to support cathode support means 64 at a desired elevation within cathode chamber 26A.

In operation, with a suitable electrolyte liquid in tank 10, a selected current density is maintained in the annular space between cathode strip material 68 and anode 52 and/or 58 by electrical source 98. This develops an electrodeposited metal layer on strip 68, from metal ions in solution in the electrolyte. After plating, strip 68 may be removed for analysis and testing simply by removing or loosening cathode connector 70 from cathode support means 64.

It will be apparent that upon a reading and understanding of the foregoing description, numerous alterations and modifications to the preferred structure illustrated will occur to those skilled in the art which modifications and alterations are nonetheless within the spirit of the present invention. It is intended to include such modifications and alterations within the scope of the appended claims.

Having thus described the invention, what is claimed is:

1. An electroplating test cell comprising:

a. a tank having a bottom wall and a side wall defining a main chamber;

b. a housing within said main chamber and having an outer peripheral wall, a top and a bottom defining a housing chamber;

c. means for supporting said housing within said main chamber;

d. cathode support means carrying cathode connector means thereon and being disposed within said housing chamber and adapted to support a generally annular cathode thereon in electrical contact with said cathode connector means;

e. anode support means disposed within said housing chamber;

f. annular anode means carried by said anode support means outwardly of said cathode support means to define an annular space therewith;

g. rotation/support means for rotatably mounting and effecting rotation of said cathode support means, and thereby a cathode supported thereon, within said housing chamber, said rotation/support means including adjustable mounting means supported within said tank and being adjustable for movement within said cathode compartment to support said cathode support means for positioning thereof at a selected one of different positions within said housing chamber;

h. an inlet conduit disposed in liquid flow communication with said housing chamber to introduce a liquid electrolyte therein, and an outlet conduit disposed in liquid flow communication with said housing chamber to withdraw liquid electrolyte therefrom; and i. electrical connector means adapted to connect said anode and said cathode connector means to respective terminals of an electrical source.

2. The test cell of claim 1 wherein said rotation/support means further includes drive means connected to said cathode support means for effecting said rotation thereof, said adjustable mounting means having one end thereof supporting said cathode support means at said selected different positions.

3. The test cell of claim 1 wherein said inlet conduit is connected directly to said housing.

4. The test cell of claim 1 wherein said top of said housing is provided by a top wall and said bottom of said housing is provided by a bottom wall and said housing further includes a compartmental wall disposed therein and defining an inner cathode compartment and an annular anode compartment disposed outwardly about said cathode compartment.

5. The test cell of claim 4 wherein said cathode compartment is in liquid flow communication with said main chamber of said tank, said inlet liquid conduit is connected to said housing in liquid flow communication with said anode compartment and said compartmental wall is apertured for liquid flow communication between said anode compartment and, via said cathode compartment, said main chamber of said tank.

6. The test cell of claim 5 wherein said top wall of said housing has a central aperture formed in the cathode compartment portion thereof and at least a component of said rotation means extends through said central aperture.

7. The test cell of claim 6 wherein said bottom wall of said housing has at least one aperture formed in the cathode compartment portion thereof.

8. The test cell of claim 6 wherein said central aperture has a diameter larger than that of said cathode support means whereby to permit passage of said cathode support means through said central aperture.

9. The test cell of claim 1 further including an annular cathode affixed to said cathode support means in electrical conducting contact with said cathode connector.

10. The test cell of claim 9 wherein said anode is comprised of metal, said annular cathode is comprised of a strip of metal, said cathode connector and said shaft are made of metal and disposed in electrical conducting contact with each other whereby said shaft and said cathode connector cooperate to provide a portion of said electrical connector means, and said housing, said cathode support means and said tank are made of electrically non-conductive materials.

11. The test cell of claim 1 wherein said annular anode means comprises an outer annular anode and an inner annular anode disposed inwardly of said outer annular anode, and said anode support means comprises first anode support means supporting said outer annular anode and second anode support means supporting said inner annular anode.

12. The test cell of claim 11 wherein said outer annular anode is disposed within said anode compartment and said inner annular anode is disposed within said cathode compartment.

13. The test cell of claim 1 wherein said anode means is disposed within said anode compartment.

14. The test cell of claim 1 wherein said anode means is disposed within said cathode compartment.

15. The test cell of claim 1 wherein said annular anode means are of perforate construction whereby to admit the passage of a liquid therethrough.

16. The test cell of claim 1 further including heat exchange means disposed within said tank for heat exchange with liquid contained therein.

17. The test cell of claim 1 wherein said bottom of said housing has at least one aperture formed therein for passage of liquid therethrough, and said housing is supported with its bottom raised above said bottom wall of said tank and with its top sufficiently below the top of said tank so as to enable the maintenance of a static pressure head of liquid above said housing.

18. An electroplating test cell comprising:

a. a tank having a bottom wall and a side wall defining a main chamber;

b. a housing supported within said main chamber and having an outer peripheral wall, a top and a bottom defining a generally cylindrical housing chamber, and a cylindrical compartmental wall disposed within said chamber and defining a generally cylindrical inner cathode compartment and an annular outer anode compartment, said compartmental walls have a plurality of apertures spaced about the periphery thereof and connecting said anode compartment in liquid flow communication with said cathode compartment;

c. cathode support means having a generally cylindrical support surface and carrying cathode connector means thereon, said cathode support means being disposed within said cathode compartment and adapted to support a generally annular cathode thereon in electrical contact with said cathode connector means;

d. first anode support means disposed within said anode chamber and second anode support means disposed inwardly of said first anode support means;

e. an outer annular anode carried by said first anode support means and an inner annular anode carried by said second support means inwardly of said outer annular anode, said outer and inner annular anodes being disposed outwardly of said cathode support means to define an annular space therewith;

f. adjustable mounting means extending within said cathode compartment and supporting said cathode support means at a selected one of different elevations within said cathode compartment, said mounting means supporting said cathode support means for rotation about the longitudinal axis of said cylindrical support surface thereof;

g. a drive shaft having one end thereof connected to said cathode support means for rotation thereof;

h. an inlet conduit disposed in liquid flow communication with said anode compartment to introduce a liquid electrolyte therein, and an outlet conduit disposed in liquid flow communication with said cathode compartment to withdraw liquid electrolyte therefrom; and i. electrical connector means adapted to connect said inner anode and said outer anode and said cathode connector means to respective terminals of an electrical source.

19. The test cell of claim 18 wherein said outer anode is disposed within said anode compartment and said inner anode is disposed within said cathode compartment.

20. The test cell of claim 18 wherein said inner and outer anodes are of perforate construction for passage of liquid therethrough.

21. The test cell of claim 18 wherein said tank, said housing and said cathode support means are made of dielectric material.

22. The test cell of claim 18 wherein said housing is disposed sufficiently below the top of said tank so as to enable the maintenance of a static head of liquid above said housing.

23. An electroplating test cell comprising:

a. a tank having a bottom wall and a side wall defining a main chamber;

b. a housing within said main chamber and having an outer peripheral wall, a top and a bottom defining a housing chamber;

c. means for supporting said housing within said main chamber;

d. cathode support means carrying cathode connector means thereon and being disposed within said housing chamber and adapted to support a generally annular cathode thereon in electrical contact with said cathode connector means;

e. anode support means disposed within said housing chamber;

f. annular anode means carried by said anode support means outwardly of said cathode support means to define an annular space therewith;

g. rotation/support means for rotatably mounting and effecting rotation of said cathode support means, and thereby a cathode supported thereon, within said housing chamber, said rotation/support means comprising a support and adjustably fastened to said bottom of said housing and having one end supporting said cathode support means at a selected one of said different positions, and drive means connected to said cathode support means for effecting rotation thereof, said stud projecting upwardly into said cathode compartment and terminating therein in a bearing and comprising said one end, and said cathode block having a bearing seat thereon which is seated upon said bearing end.

24. The test cell of claim 23 wherein said drive means comprises a drive shaft having one end thereof connected to said cathode support means, and said support stud and said cathode support means are movable relative to said bottom of said housing in a direction parallel to the longitudinal axis of said shaft.

25. The test cell of claim 24 wherein said shaft has a second end opposite said one end and said second end is operatively engaged with a motor means for rotation of said shaft and thereby said cathode support means.

26. The test cell of claim 25 wherein said cathode connector and said shaft are made at least in part of metal and said cathode connector is disposed in electrical conducting contact with said shaft whereby said shaft and said cathode connector cooperate to provide a portion of said electrical connector means.

* * * * *

UNITED STATES PATENT AND TRADEMARK OFFICE

CERTIFICATE OF CORRECTION

PATENT NO. : 4,102,770

DATED : July 25, 1978

INVENTOR(S) : William L. Moriarty et al

It is certified that error appears in the above-identified patent and that said Letters Patent are hereby corrected as shown below:

Column 10, line 30, after "support", the word "and" should be -- stud --

Signed and Sealed this

*Sixth* Day of *February 1979*

[SEAL]

*Attest:*

RUTH C. MASON
*Attesting Officer*

DONALD W. BANNER
*Commissioner of Patents and Trademarks*